United States Patent [19]

Bannister et al.

[11] 4,088,428

[45] May 9, 1978

[54] DISCHARGE VALVE ASSEMBLY FOR A COMPRESSOR

[75] Inventors: James Edward Bannister; Ralph Fredrick Connor, both of Evansville, Ind.

[73] Assignee: Whirlpool Corporation, Benton Harbor, Mich.

[21] Appl. No.: 713,709

[22] Filed: Aug. 12, 1976

[51] Int. Cl.[2] ..... F01C 21/12; F04B 21/02; F16K 15/14

[52] U.S. Cl. ..... 418/270; 417/454; 137/855

[58] Field of Search ..... 418/259, 270; 417/454; 137/855, 856

[56] References Cited

U.S. PATENT DOCUMENTS

| | | | |
|---|---|---|---|
| 3,112,063 | 11/1963 | Larsson | 417/559 |
| 3,809,511 | 5/1974 | Linder et al. | 418/270 |
| 3,811,468 | 5/1974 | Bellmer | 137/856 |

FOREIGN PATENT DOCUMENTS

| | | | |
|---|---|---|---|
| 728,658 | 4/1932 | France | 137/855 |
| 2,430,220 | 1/1975 | Germany | 418/270 |

*Primary Examiner*—John J. Vrablik

*Attorney, Agent, or Firm*—Wegner, Stellman, McCord, Wiles & Wood

[57] ABSTRACT

A rotary compressor having a discharge check valve and retainer assembly in which the valve is a reed type valve mounted on the retainer and the retainer having spaced locating projections for positioning the assembly in a valve chamber. The retainer has arcuate end portions that when undistorted have a curvature greater than the corresponding end portions of the chamber so that the retainer and thus the valve is locked securely in position in the chamber by the distortion of the end portions and the projections.

9 Claims, 6 Drawing Figures

DISCHARGE VALVE ASSEMBLY FOR A COMPRESSOR

BACKGROUND OF THE INVENTION

This invention relates to rotary compressors and particularly to an improved discharge check valve and retainer means therefor assembly with positioning means for locking the retainer and thus the valve in proper position in a muffler or valve chamber on the high pressure side of the compressor.

In conventional rotary compressors, particularly of the type used in refrigeration, a rotor blade sweeps about a compression chamber to compress the gas such as a refrigerant gas that is delivered to the chamber through an inlet opening. This compressed gas is discharged from the chamber through an outlet opening spaced circumferentially from the inlet opening into a muffler or valve chamber. Located in this valve chamber is a check valve customarily of the reed type that is distorted and held against the outlet opening to prevent back flow, but yieldable under gas pressure to permit the compressed gas to flow into the valve chamber. This invention is concerned with an improved such check valve and retainer assembly for positioning the check valve properly within the valve chamber without requiring additional fastening means.

The prior art considered in preparing this patent application consisted of U.S. Pat. Nos. 2,065,062; 3,112,063; 3,568,712; 3,676,021; 3,727,420 and 3,912,422.

SUMMARY OF THE INVENTION

The present invention is concerned with a discharge check valve and retainer means assembly for the high pressure outlet portion of a compressor wherein the check valve is automatically retained in proper position in a muffler or valve chamber without requiring additional fastening means other than the cooperation of portions of the retainer with portions of walls defining the valve chamber.

It can thus be seen that the assembly of this invention is not only reliable in the proper positioning and operation of the valve but also requires no additional fastening parts so that not only is the assembly inexpensive but is easy to introduce into the compressor during manufacture thereof.

DESCRIPTION OF THE PREFERRED EMBODIMENT

Figure 1:
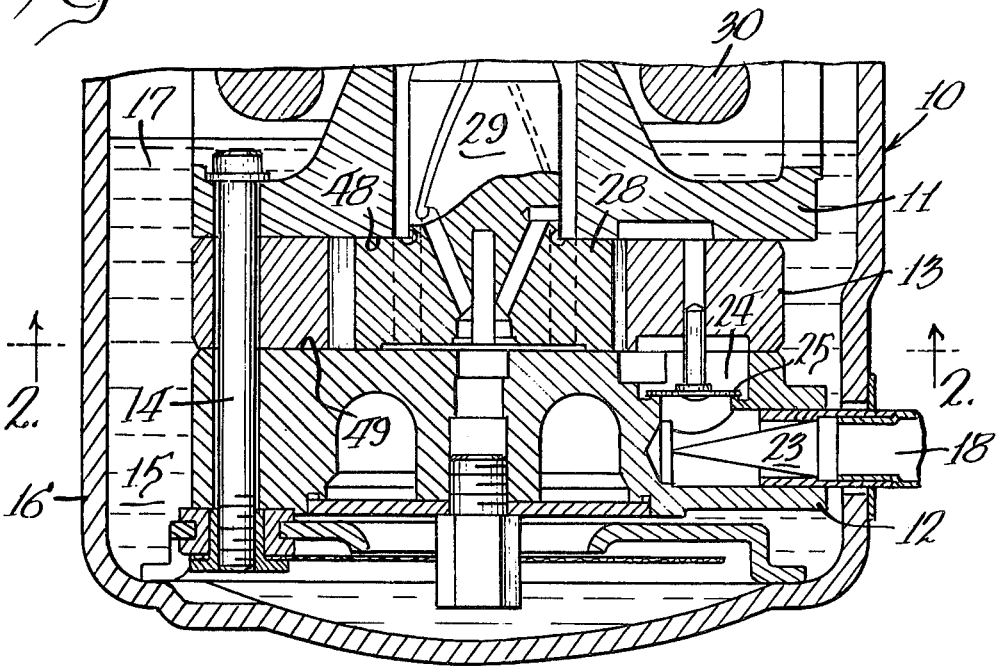
FIG. 1 is a fragmentary longitudinal sectional view through a portion of a rotary compressor embodying the invention.

In the illustrated embodiment of the invention a rotary compressor 10 comprises a front head 11, a rear head 12, and a cylinder 13 which may be secured together by suitable means such as bolts 14. The assembly is carried in a lower sump portion 15 defined by an outer hermetically sealed housing 16 adapted to hold a body of lubricating oil 17 for lubricating the running parts of the compressor in the conventional manner.

In the illustrated embodiment, compressor 10 comprises a rotary compressor for use in compressing refrigerant gas and the like. The gas to be compressed is delivered to the compressor through an inlet conduit 18.

Cylinder 13 defines a generally cylindrical compression chamber 19, an inlet 20 opening to chamber 19 and an outlet 21 opening from the chamber 19 at a position spaced from inlet 20 circumferentially of the side wall 22 of chamber 19. The compressible gas is delivered from inlet conduit 18 to inlet 20 through a conventional filter 23 and an inlet passage 24 provided with a conventional check valve 25. Outlet 21 communicates with a muffler or valve chamber 26.

Figure 2:
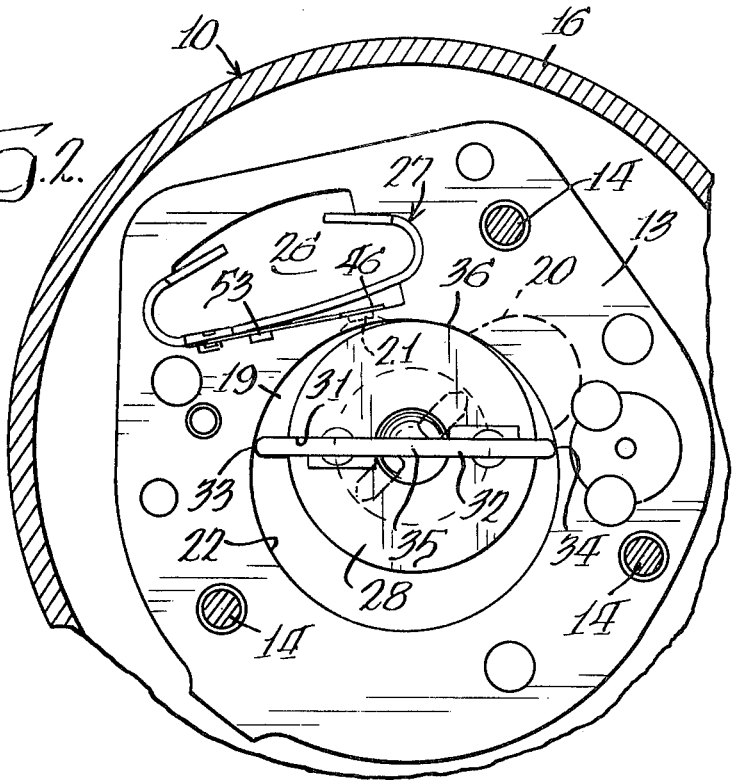
FIG. 2 is a transverse section through the compressor of FIG. 1 taken substantially along line 2—2 of FIG. 1.

Pumping of the compressible gas in the chamber 19 is effected by a rotor 28 provided at one end of a shaft 29 driven by a suitable electric motor 30 within housing 16. As best seen in FIG. 2, the rotor 28 is provided with a diametric slot 31 in which a one-piece blade 32 is slidably fitted. The specific configuration of the generally cylindrical chamber side wall 22, the length of blade 32 between the opposite ends 33 and 34 thereof, and the location of the axis 35 of rotor 28 are selected so as to cause the blade ends 33 and 34 to engage the chamber side wall 22 in all rotational positions of the rotor. The rotor axis 35 is eccentrically positioned relative to the cylindrical chamber 19 with the rotor substantially engaging the side wall 22 at the upstream end 36 of the inlet opening 20.

The valve assembly and retainer means 27 embodying the invention is illustrated in enlarged detail in FIGS. 3-6. As illustrated, the assembly is located in a valve chamber 26 which may also serve as a muffler, and which is defined by wall means including first 37 and second 38 arcuate end portions and an intermediate substantially planar wall portion 39 intersected by the pressure gas discharge outlet 21.

Figure 3:
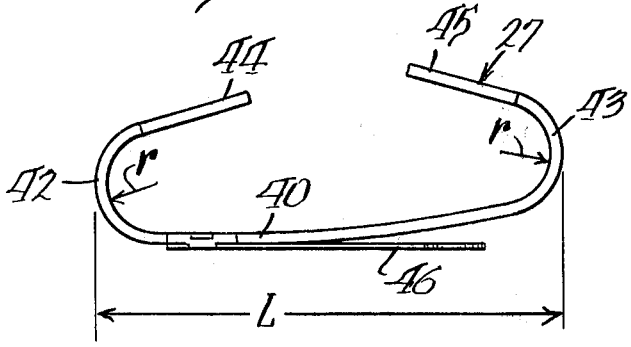
FIG. 3 is a detail plan view of a discharge check valve and retainer means assembly embodying the invention.
Figure 4:
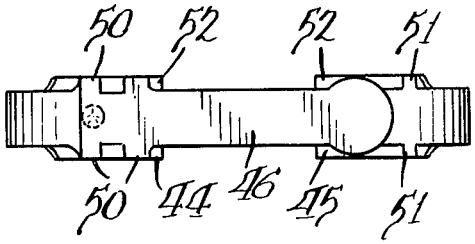
FIG. 4 is a front elevational view of the assembly of FIG. 3.
Figure 5:
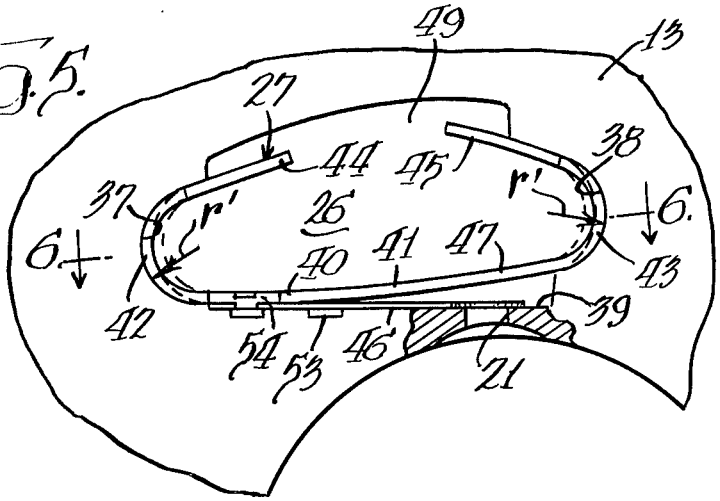
FIG. 5 is an enlarged fragmentary view partially broken away of a portion of the sectional view of FIG. 2.
Figure 6:
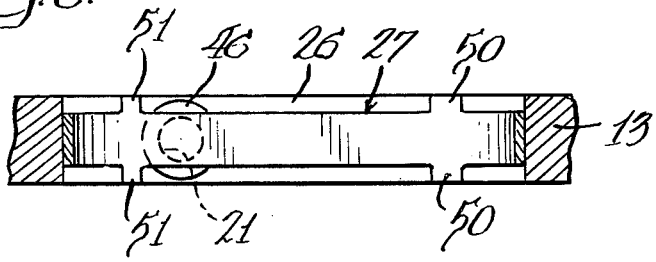
FIG. 6 is a view taken substantially along line 6—6 of FIG. 5.

Located in the chamber 26 is the discharge check valve and retainer means assembly 27. This assembly comprises a relatively continuous but resilient strip 40, such as of steel, having a central portion 41 and first 42 and second 43 arcuate end portions corresponding to the first 37 and second 38 arcuate end portions of the chamber 26. The strip end portions 42 and 43 when not deformed and free as shown in FIG. 3 have radii indicated as $r$ in FIG. 3 that are greater than the radii of the corresponding wall end portions indicated by $r'$ of the chamber 26 as indicated in FIG. 5. The result is that when the strip 27 is deformed as by pressing the terminal end portions 44 and 45 toward the central portion 41 and inserting the strip into the cavity 26 the released end portions tending to spring back toward the original positions of FIG. 3 securely lock the strip 41, and thus the reed valve 46 mounted thereon, within the valve chamber 26.

This strip central portion 41 has an end part 47 spaced from the intermediate portion of the wall means in the area adjacent to the discharge outlet 21 and the resilient valve 46 is mounted on the retainer such as by spot welding so as to be biased outwardly against the intermediate wall portion 39 to cover or overlie the pressure outlet 21. This bias is a result of the natural resiliency in the illustrated embodiment of the reed valve strip 46 and the engagement between the leftcentral portion 54 of the strip central portion 41 with planar wall portion 39.

The wall means defining the chamber 26 and comprising the cylinder 13 has top 48 and bottom 49 walls defining the top and bottom of the chamber 26. The valve retainer strip 40 includes spaced locating projections 50, 51 and 52 for positioning the strip, and thus the valve 46, properly between these top and bottom walls and in proper relationship to the high pressure gas outlet 21. These projections 50 and 51 are in the form of tabs that are relatively narrow while the projections 52 are the broadened terminal ends 44 and 45 of the strip 40 itself. These terminal end locating projections 52 are located adjacent to but beyond the arcuate end portions 42 and 43 of the strip 40.

The wall portions forming the valve chamber 26 are provided with a cavity 53 comprising an oil and dirt trap.

In the illustrated embodiment, the end portions 42 and 43 of the strip 40 and the corresponding end portions 37 and 38 of the cavity 36 are each of substantially constant radius. The strip ends 44 and 45 are substantially tangent to these strip and wall end portions, as can be seen in both FIGS. 3 and 5.

The arcuate end portions of strip 40 serve to position the valve retainer assembly properly within the valve chamber 26 and urge the left-central portion of the strip, shown at 54, into engagement with the planar chamber wall 39, thereby assuring proper positioning and biasing of valve 46 with respect to the outlet 21. Although arcuate end portions 42 and 43 of the strip 40 are illustrated as continuously contacting the corresponding chamber wall portions 37 and 38, such continuous engagement is not required for successful practice of the invention. Rather, it is only necessary that the end portions of strip 40 engage the chamber wall in the vicinity of the terminal end portions 44 and 45 and at points adjacent the ends of planar chamber wall 39, a gap between one or both of the arcuate strip end portions 42, 43 and the corresponding chamber wall being permitted. Such engagement is illustrated by the dashed lines in FIG. 5. Thus, the precise relationship between the radius r of the strip ends and the radius $r'$ of the chamber end walls is not critical, as long as $r$ is made somewhat larger than $r'$. By way of example, where the chamber end wall radius $r'$ is 0.187 inches, the strip end radius may be 0.200 inches.

Because continuous engagement between the arcuate strip ends and the chamber end walls is not required, particular advantage is obtained in that the other valve retainer dimensions, such as its free length L shown in FIG. 3, are rendered non-critical. This facilitates mass production of the valve assembly and results in a very low rate of rejection for the parts produced.

The foregoing disclosure of specific embodiments is illustrative of the broad inventive concepts comprehended by the invention.

Having described the invention, the embodiments of the invention in which an exclusive property or privilege is claimed are defined as follows:

1. In a rotary compressor having means defining a compression chamber, a low suction pressure inlet to said chamber, a high discharge pressure outlet from said chamber and compressor means in said chamber between said inlet and said outlet, a discharge check valve and retainer means assembly, comprising:

wall means defining an elongated valve chamber communicating with said discharge pressure outlet having first and second arcuate end wall portions and an intermediate wall portion therebetween intersected by said discharge pressure outlet;

a valve retainer comprising a relatively stiff but resilient strip having a central portion and first and second arcuate end portions corresponding to said first and second arcuate end portions of said valve chamber, said strip end portions each having a free undeformed radius greater than that of the corresponding wall end portions for resilient retention of said retainer in said valve chamber by distortion of said strip end portions, said strip central portion having a part thereof spaced from said wall means intermediate portion in the area of said discharge pressure outlet; and a resilient valve member mounted on said retainer between its said central portion and said pressure outlet and biased against said intermediate wall portion to overlie said pressure outlet.

2. The compressor of claim 1 wherein said central portion of said strip has one end adjacent to said intermediate wall portion and an opposite end spaced therefrom, the resilient valve member having one end attached to said central portion at the end adjacent to said intermediate wall portion and the other end of the valve member spaced from said other end of said central portion.

3. The compressor of claim 1 wherein said arcuate end wall portions and said arcuate end strip portions are each of substantially constant radius and said strip is provided with terminal ends each of which is substantially tangent to the corresponding said arcuate end portion.

4. The compressor of claim 1 wherein said valve chamber wall means includes top and bottom walls and said valve retainer strip comprises spaced locating projections adjacent to said top and bottom walls for positioning of said valve retainer and thus said resilient valve member relative to said pressure outlet.

5. The compressor of claim 4 wherein said central portion of said strip has ends provided with tabs comprising said projections.

6. The compressor of claim 4 wherein said locating projections comprise terminal ends of said strip located adjacent to but beyond said strip arcuate end portions.

7. In a rotary compressor having means defining a compression chamber, a low suction pressure inlet to said chamber, a high discharge pressure outlet from said chamber and compressor means in said chamber between said inlet and said outlet, a discharge check valve and retainer means assembly, comprising:

wall means defining an elongated valve chamber communicating with said discharge pressure outlet having first and second arcuate end wall portions and an intermediate wall portion therebetween intersected by said discharge pressure outlet;

a valve retainer comprising a relatively stiff but resilient strip having a central portion and first and second arcuate end portions corresponding to said first and second arcuate end portions of said valve chamber, said strip end portions each having a free undeformed radius greater than that of the corresponding wall end portions for resilient retention of said retainer in said valve chamber by distortion of said strip end portions, said strip central portion having a part thereof spaced from said wall means intermediate portion in the area of said discharge pressure outlet;

a resilient valve member mounted on said retainer between its said central portion and said pressure outlet and biased against said intermediate wall portion to overlie said pressure outlet, said valve chamber wall means including top and bottom walls and said valve retainer strip comprising spaced locating projections adjacent to said top and bottom walls for positioning of said valve retainer and thus said resilient valve member relative to said pressure outlet; and tabs comprising said projections on the opposite ends of said central portion of said strip, said locating projections comprising terminal ends of said strip located adjacent to but beyond said strip arcuate end portions.

8. The compressor of claim 7 wherein said central portion of said strip has one end adjacent to said intermediate wall portion and an opposite end spaced therefrom, the resilient valve member having one end attached to said central portion at the end adjacent to said intermediate wall portion and the other end of the valve member spaced from said other end of said central portion.

9. The compressor of claim 7 wherein said arcuate end wall portions of said valve chamber and said arcuate end strip portions are each of substantially constant radius and said strip is provided with terminal ends each of which is substantially tangent to the corresponding arcuate said end portion, the terminal ends each being of a width sufficient to comprise said spacing projections and additional said spacing projections comprising pairs of tabs projecting from the opposite ends of said strip central portion.

* * * * *